US009302441B2

(12) United States Patent
Spiesshofer et al.

(10) Patent No.: US 9,302,441 B2
(45) Date of Patent: Apr. 5, 2016

(54) METHOD OF OPERATING A PRESS WITH A BOTTOM DRIVE AND PRESS OPERATED ACCORDING TO THIS METHOD

(75) Inventors: Thomas Spiesshofer, Bermatingen (DE); Christian Kapler, Ravensburg (DE); Gebhard Engler, Ertingen (DE)

(73) Assignee: Schuler Pressen GmbH, Goeppingen (DE)

( * ) Notice: Subject to any disclaimer, the term of this patent is extended or adjusted under 35 U.S.C. 154(b) by 413 days.

(21) Appl. No.: 13/818,368

(22) PCT Filed: Aug. 23, 2011

(86) PCT No.: PCT/DE2011/075197

§ 371 (c)(1),
(2), (4) Date: Feb. 22, 2013

(87) PCT Pub. No.: WO2012/041313

PCT Pub. Date: Apr. 5, 2012

(65) Prior Publication Data

US 2013/0151002 A1 Jun. 13, 2013

(30) Foreign Application Priority Data

Aug. 24, 2010 (DE) ..... 10 2010 035 349
Aug. 19, 2011 (DE) ..... 10 2011 052 860

(51) Int. Cl.
*B30B 15/14* (2006.01)
*B30B 1/26* (2006.01)
*B30B 1/28* (2006.01)

(52) U.S. Cl.
CPC ..... *B30B 15/14* (2013.01); *B30B 1/266* (2013.01); *B30B 1/28* (2013.01); *B30B 15/148* (2013.01)

(58) Field of Classification Search
CPC ..... B30B 15/14; B30B 1/266; B30B 1/28; B30B 15/148
USPC ..... 700/206
See application file for complete search history.

(56) References Cited

U.S. PATENT DOCUMENTS 1,711,260 A * 4/1929 Caminez ..... 74/55
3,201,218 A * 8/1965 Wythe ..... 65/330

(Continued)

FOREIGN PATENT DOCUMENTS

AT 215 257 5/1961
DE 25 07 098 8/1975

(Continued)

OTHER PUBLICATIONS

Rangwala, A.S., "Reciprocating Machinery Dynamics", 2006, New age international, First Edition, p. 206-207.*

*Primary Examiner* — Ryan Jarrett
*Assistant Examiner* — Alan Chu
(74) *Attorney, Agent, or Firm* — Cohen & Hildebrand, PLLC

(57) ABSTRACT

The present invention provides a method for operating a press which includes providing a press with at least one plunger which executed a stroke, an upper tool part, a sub-structure. A control and regulation device receives a value(s) on an operating condition from a system of the press. The value(s) are provided from the system of the press to the control and regulation device during a processing of a work piece. The value(s) provided are processed to the control and regulation device according to a function $$F(x) = \frac{L}{x} \cdot F_2$$

under the condition that $$L > x > \frac{L}{2}$$

so as to permanently operate a movement of the plunger via a drive device and the press in a controlled manner or in a regulated manner according to a system of forces required for a work piece with a respective force which is actively influenced or is actively modified in a position and a dimension/amount.

51 Claims, 4 Drawing Sheets

(56) References Cited

U.S. PATENT DOCUMENTS

| | | | | |
|---|---|---|---|---|
| 3,855,839 | A | 12/1974 | Lose et al. | |
| 4,020,671 | A | 5/1977 | Oberheim et al. | |
| 4,252,009 | A * | 2/1981 | Grohoski | 72/90 |
| 5,692,404 | A * | 12/1997 | Kirii et al. | 72/15.1 |
| 5,808,904 | A * | 9/1998 | Rasmussen et al. | 702/42 |
| 5,852,970 | A * | 12/1998 | Bornhorst et al. | 100/346 |
| 5,882,158 | A * | 3/1999 | Lechleiter et al. | 409/146 |
| 6,325,331 | B1 * | 12/2001 | McKeown | 244/76 A |
| 6,484,106 | B1 * | 11/2002 | Schoch | 702/34 |
| 6,848,338 | B1 * | 2/2005 | Gieskes et al. | 74/821 |
| 2003/0116037 | A1 | 6/2003 | Tanaka et al. | |
| 2005/0204798 | A1 * | 9/2005 | Imaeda | 72/443 |
| 2006/0012326 | A1 | 1/2006 | Iwashita et al. | |
| 2008/0016940 | A1 | 1/2008 | Schmeink | |
| 2009/0217724 | A1 * | 9/2009 | Bosga et al. | 72/29.2 |
| 2010/0206187 | A1 | 8/2010 | Hafner et al. | |

FOREIGN PATENT DOCUMENTS

| | | | |
|---|---|---|---|
| DE | 119 014 | | 4/1976 |
| DE | 10 2005 040263 | A1 | 3/2007 |
| EP | 1 321 285 | A2 | 6/2003 |
| EP | 1 612 037 | A2 | 1/2006 |
| EP | 1 880 837 | A2 | 1/2008 |
| EP | 2 008 799 | A1 | 12/2008 |

* cited by examiner

METHOD OF OPERATING A PRESS WITH A BOTTOM DRIVE AND PRESS OPERATED ACCORDING TO THIS METHOD

CROSS REFERENCE TO PRIOR APPLICATIONS

This application is a U.S. National Phase application under 35 U.S.C. §371 of International Application No. PCT/DE2011/075197, filed on Aug. 23, 2011 and which claims benefit to German Patent Application No. 10 2010 035 349.3, filed on Aug. 24, 2010 and to German Patent Application No. 10 2011 052 860.1, filed on Aug. 19, 2011. The International Application was published in German on Apr. 5, 2012 as WO 2012/041313 A2 under PCT Article 21(2).

FIELD

The present invention relates to a method for operating a press with a bottom drive. The present invention also relates to a press operated according to this method comprising a drive device disposed in a sub-structure and connected to drive elements and having at least one motor or servomotor, a plunger executing a stroke and accommodating at least one upper tool part, several tie rods or connecting rods acting on the plunger for transmitting the drive for the stroke of the plunger, at least one lower tool part disposed in the sub-structure and associated with the plunger and the corresponding upper tool part and an open-loop and closed-loop control device, wherein the stroke of the plunger is driven above or ahead of a top dead center to or above a bottom dead center.

As defined by the present invention, the press is applicable for forming, compacting, briquetting and cutting materials of any type and also usable as a transfer press or in press lines.

BACKGROUND

The prior art generally teaches that the plunger is continuously driven, via a combination of tie rods/connecting rods, by a compact drive unit in a sub-structure of the press.

It is known from doctrinal technical literature that presses with bottom drives are predominantly implemented as presses with a small target force and a high number of strokes and not so much as so-called large presses.

It is further indicated that the tie rods/connecting rods acting laterally on the plunder lead to greater bending stress and to a correspondingly great bending of the plunger, but that the line of action of forces acting off-center on the plunger always lies between the pivot points of the tie rods/connecting rods.

The tie rods/connecting rods are also frequently guided in supporting stands (at least above the sub-structure) which are connected to a cross-beam located above the supporting stands and forming the plunger, thus virtually forming a press frame for forces that may occur and are to be absorbed.

The person skilled in the art aims at designing the press with regard to occurring forces, according to the actions required for processing the work pieces and also the reactions to press shocks or bending, so that a supporting stand construction is chosen in the press frame.

As a result of this technical overview, cost-effective solutions are being sought for designing and operating such presses with bottom drives, also as large presses, without the disadvantages set forth in the individual examples below, such as, for example, as a supporting stand construction.

The analysis of exemplary implementations of presses with a bottom drive, known as individual solutions, shows:

AT 215 257 describes a press where the protruding flywheel requires a lot of enclosed space. Due to the complex lever kinematics, potentially required shock absorption becomes ineffective and could, if required, only be compensated for by high material usage. The inevitable transmission of the off-center forces mentioned above is inefficient due to the flexible reaction of the lever kinematics. The relatively high number of mobile machine elements only creates small relative movements, such as for the stroke of the plunger, when high press forces are to be transmitted. The possibilities for situational or process-related forced releases are limited and it lacks an operating system for overload protection.

DE 25 07 098 describes a press which also requires a lot of enclosed space due to big constructional elements. The lever kinematics is disadvantageously disposed in parts in the sub-structure and in part in the upper support structure so that the upper support structure becomes an essential component of the press which absorbs forces. Integrating this press into the configuration of modern transfer presses or press lines is not possible without additional bypass routes, such as so-called block bypasses in the T-Track.

DD 119 014 describes a press where the construction height and complex guides do not allow for integration into lines of said transfer presses. The off-center forces described in the introduction are also poorly transferrable.

A punching press with a bottom drive is also described in EP 2 008 799 A1 in which the plunger is driven via tension columns by a drive mechanism with a crankshaft and a plunger disposed under the processing level. Bearing loads are hereby to be reduced by a special transmission mechanism and a distribution of the plunger forces and a high precision is to be achieved at high punching frequencies. With regard to the requirements for presses with a bottom drive that are to be developed, the disadvantage is here that work process-related settings can only be modified by adjusting the vertical position of the pivot point on the structure of the press. This solution does not allow for detecting and controlling the complex forces acting from the piston according to the processing requirements of the respective work piece across a major operating area. The distribution of the plunger forces influenced by the servo-motor could furthermore only be implemented in pure punching presses to a limited extent.

Presses were originally driven by an electric motor and an energy-storing flywheel. Energy efficient drives have meanwhile prevailed in the form of servo-electric drives. EP 1 880 837 A2 describes, for example, a press arrangement with energy management of a servo drive by which there is a sufficient capacity for absorbing additional energy on the one hand and enough energy is available at any given time in order to fulfill the respective press cycle.

In the context of an advantageous control and regulation of the movement of the plunger for servo-electrically driven presses, the problem of allowing for a position-controlled and force-controlled repeatable sequence of the movement of the plunger, wherein off-center forces are also to be controlled, is described in DE 10 2005 040 263 A1. In principle, this is solved by target torques of the servo-motors for driving the plunger being regulated depending on influencing variables by means of a position-curve slide controlled by a virtual drive shaft and a force and torque limiting value, which is controlled depending on the operating mode. The method and the device to this effect are supposed to be applicable to presses with a top drive and bottom drive, but in presses with a bottom drive, this solution requires particular, complex arrangements in the bottom drive and available space in the sub-structure, which is limited in this regard.

Considering the above conclusions, that:

- presses with a sub-structure are to be implemented as large presses,
- the line of action of off-center forces acting on the plunger always lies between the pivot points of the tie rods/connecting rods,
- the tie rods/connecting rods in presses with a sub-structure are frequently guided in supporting stands, thus virtually forming a press frame for forces that may occur and are to be absorbed, because a supporting stand construction in said press frame is frequently chosen with regard to occurring forces according to the actions for processing the work pieces and to the reactions to press shocks or bending,
- servo-electric drives must be implemented in the bottom drive, and
- complex influences should not disturb the operation of the plunger, as a result of this technical overview (also with regard to DE 10 2005 040 263 A1) cost-effective solutions must be found for implementing and operating class-specific presses with bottom drives, also as large presses, without the disadvantages, such as, for example, a support stand construction, as indicated in the individual examples above.

SUMMARY

An aspect of the present invention is to provide a press with a bottom drive as assembled above, that, according to the method, provides an optimized force and travel progression of the plunger and its stroke by means of a control and regulation device and more specifically develops the operating method in such a manner that the forces acting from the plunger act in a differentiated manner according to the processing requirements of the respective work piece on the one hand, but also cover a greater operating area.

To this end, it is not enough to influence the forces in a position-controlled and force-controlled way as, for example, in DE 10 2005 040 263 A1, and to regulated off-center forces. It is rather necessary to increase the areas of acting forces and to adequately provide a method or a function by which complex conditions and forces acting in the system are largely detected and can be regulated in a better way than before.

The press operated according to the present method must also be cost-effectively usable as a large press in press lines and establish a force potential for dispensing with usual supporting stand constructions with a connecting cross-beam.

In constructive terms, the aspect of the present invention is to provide a press with optimized performance characteristics in a more compact way as compared to conventional presses with a bottom drive.

In an embodiment, the present invention provides a method for operating a press with a bottom drive which includes providing a press with at least one plunger which is configured to execute a stroke, at least one upper tool part, a sub-structure. At least one drive device is disposed in the sub-structure. The at least one drive device comprises drive elements, at least one motor or servo-motor and at least one tie rod which are arranged to form at least one drive train for the at least one plunger and to receive the at least one upper tool part. At least one bottom tool part is disposed on the sub-structure. A control and regulation device is configured to receive a value(s) on an operating condition from a system of the press. The plunger is configured to act with the at least one upper tool part onto a work piece to be processed lying on the at least one bottom tool part. The stroke of the plunger is operated via or ahead of a top dead center to or via a bottom dead center. The value(s) are provided from the system of the press to the control and regulation device during a processing of the work piece. The value(s) provided are processed to the control and regulation device according to a function $$F(x) = \frac{L}{x} \cdot F_2$$

under the condition that $$L > x > \frac{L}{2}$$

so as to permanently operate a movement of the plunger via the at least one drive device and the press in a controlled manner or in a regulated manner according to a system of forces required for the work piece with a respective force which is actively influenced or is actively modified in a position and a dimension/amount. Thereby, F(x) represents a force controlled according to the function, $F_2$ represents a locally acting force, x represents an area of a variably acting force, and L represents a variable area of acting forces. The value(s) are collected and processed as data of at least one force and travel progression, and one element of the at least one drive device, a change of the operating value in the system of the press or a process of the work piece to be processed, which influence the stroke of the plunger.

BRIEF DESCRIPTION OF THE DRAWINGS

The present invention is described in greater detail below on the basis of embodiments and of the drawings in which.

DETAILED DESCRIPTION

Figure 1:
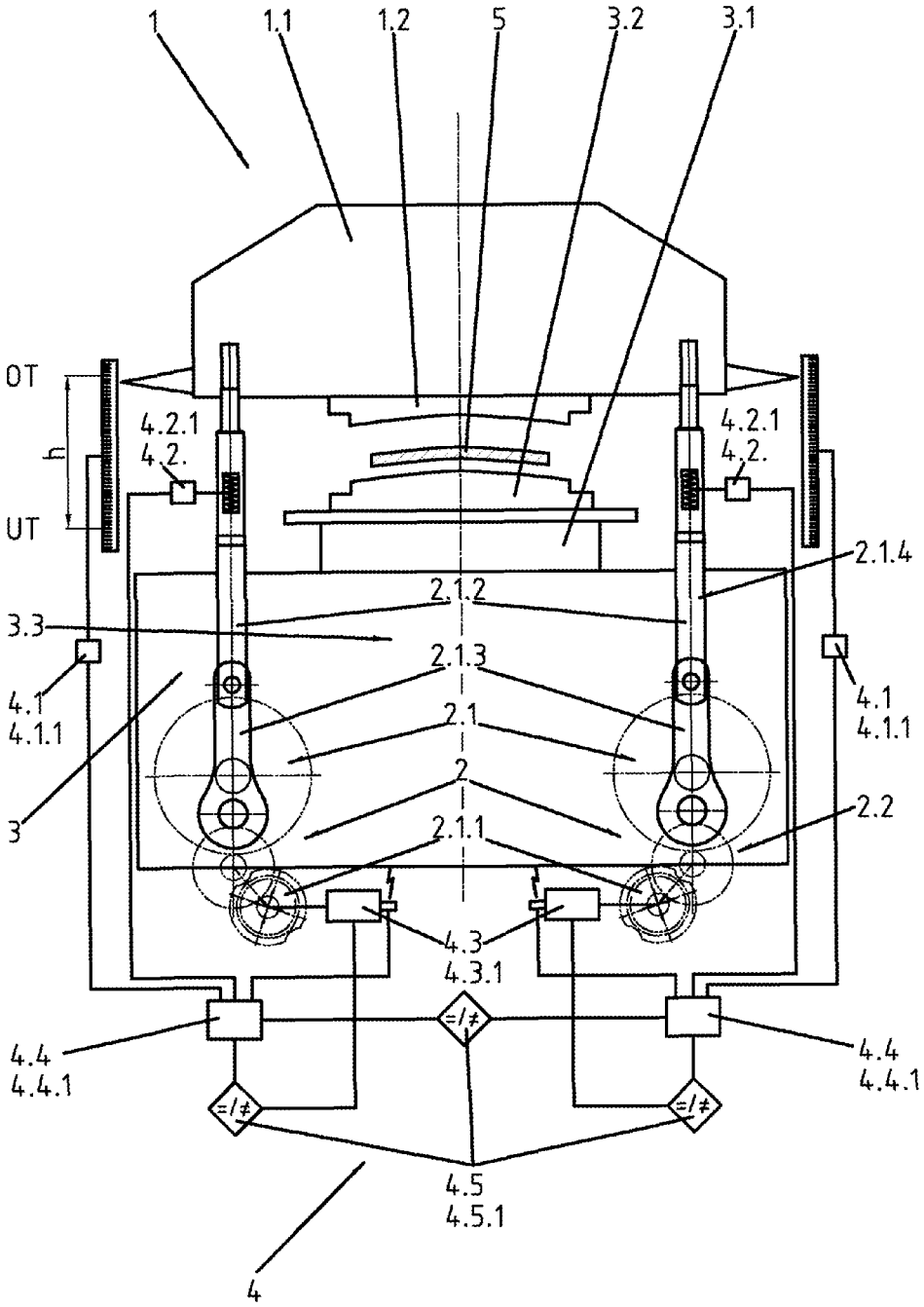
FIG. 1 shows the simplified representation of the press 1 with a bottom drive and the schematic principle of the operation according to the present invention by means of the control and regulation device 4.

The method is based on a press with a bottom drive, which has:

- at least one drive device disposed in a sub-structure and connected to drive elements, forming a drive train and comprising at least one motor or servo-motor,
- one plunger accommodating at least one upper tool part and executing a stroke above or ahead of an upper dead center toward or above a bottom dead center,
- at least one tie rod, configured with or as a connecting rod, acting on the plunger for transmitting the drive for the stroke of the plunger, and
- at least one lower tool part disposed in the sub-structure and associated with the plunger and the corresponding upper tool part, wherein the upper tool part acts on a work piece to be processed resting on the bottom tool part.

The operation of the plunger can therefore occur in an alternating or oscillating manner from the upper dead center to the lower dead center and back or cyclically from and via the upper dead center toward and via the lower dead center.

In an embodiment of the present invention, a control and regulating device is used, which, according to the method, records values from conditions in the system of the press during processing of the work piece and processes them via the drive device according to the function $$F(x) = \frac{L}{x} \cdot F_2$$

under the condition that $$L > x > \frac{L}{2}$$

into data for the movement of the plunger, so that the press is permanently operated in a controlled or regulated manner according to a system of forces required for the work piece, with a respective force, actively influenced or modified in its position and its dimension (amount). Therein:

F(x) represents a force controlled according to the function, $F_2$ represents a locally acting force, x represents an area of a variably acting force, and L represents a variable area of acting forces.

At least values such as data of a force and travel progression and of at least one element of the drive device, a change of an operating value in the system of the press or of the work piece to be processed, are recorded and processed, which influence the stroke of the plunger.

This function and the defined parameters allow for a surprising increase of the variable area of the acting forces, as is explained below and as is shown in FIGS. 2*a*) and 2*b*) in comparison to the forces acting according to the prior art. Until now, the conventional area of the acting forces has not been analyzed in detail, nor was it possible to gather suggestions or approaches from the prior art pointing to an increase of the variable area of the desired acting forces.

According to a further development of this solution principle, the values are recorded and processed as data:

a) of a force and travel progression of the plunger according to the function $f(x)=a(0)/2+a(1)*\cos(1*x)+ \ldots +$, and b) based on at least one element of the drive device, a change of an operating value in the system of the press or a process of the work piece to be processed as influenceable conditions of the stroke of the plunger according to the formula: $f(x)=a(0)/2+a(1)*\cos(1*x)+a(2)*\cos(2*x)+ \ldots +b(1)*\sin(1*x)+b(2)*\sin(2*x)+ \ldots$.

These functions for the data of the force and travel progression of the plunger as well as the other conditions affecting the stroke of the plunger allows all the forces acting from the plunger according to the processing requirements of the respective work piece to operate in a differentiated manner on the one hand, while covering a greater acting area than before on the other hand.

According to the present invention, said data is used as follows for the sequence of the method:

Collection of first data from values of a travel progression or a position in the stroke of the plunger by use of at least one first means.

Collection of second data of at least one actual value of a force or of a force-equivalent value in at least one of the drive elements of the drive device by use of at least one second means, wherein it includes at least one actual value of the force in at least one of the tie rods or at least in one connecting rod or in at least one of the tie rods and at least in one connecting rod, wherein strain gauges or piezo elements can be used in the place to be measured.

Collection of third data of at least one actual value of at least one motor of the drive device by use of at least one third means, wherein this data can stem from values of a power consumption, a torque, an electrical current, a rotational speed or a rotational angle of at least one drive element, motor or servo-motor.

Collection of fourth data of at least one actual value of a power output or of an increase in power output in the system of the press by use of at least one fourth means.

Analysis and/or regulation of at least one of the values of at least the first, second, third and/or fourth data into fifth data by use of at least one fifth means.

The control and regulation is thus configured to implement the method with the first to fifth means.

Therefore, with the method:

a) at least one data (in the sense of a data file) of the first to fourth data can be recorded and processed, analyzed or regulated into fifth data, b) this data can be processed by the fifth means and compared to values of data applying to the work piece or regulated and transmitted via the drive device and the plunger to the upper tool part and the bottom tool part as virtual control signals, whereby c) the forces acting onto the upper tool part and the bottom tool part are controlled or regulated according to the conditions of the work piece to be processed in a locally differentiated or variable manner and the forces are controlled according to a greater work area.

With the method, the processed fifth data can be processed in at least one target/actual comparison of at least one of the first to fourth collected data and fed, or regulated and fed as target values into the operation of the press by use of the fifth means in order to trigger at least one of the following actions:

modification of values to be adjusted for or fed into the operation of the press, overload protection, emergency operation or for shutdown of the press, and/or synchronous or asynchronous run of drive elements of the drive device (2).

At least one value of the first to fourth collected data and analyzed fifth data can also be used to influence reactions to the press force in the system of the press for shock absorption or in case of bending of the plunger for a modified force distribution.

The orientation, position and amount of the force can thereby be actively modified according, for example, to the "forming process", so that partial functions of a so-called die cushion apparatus can be assumed or actively supported as an effect merged with the main function. In this respect, the principle of the present invention is also adapted to presses with a bottom drive using elements of a die cushion apparatus, for which functions according to the present invention are specified in the following (wherein constructive details of the cushion apparatus have previously been described in the art).

The data for the overload protection, emergency operation or shutdown of the press should be triggered before reaching a set value of at least one of the first to fourth collected data and fifth analyzed data of an action or reaction force.

The data of at least one of the first to fourth collected and fifth analyzed values are particularly appropriately measured, analyzed and, in case of a deviation from the target specification, newly specified as a gradient of an increasing dimension or of a position of at least one of the drive elements, for modification of the distribution for an action or reaction force.

The present invention thus not only makes it possible, as before, to measure and analyze the data of at least one of the first to fourth collected and fifth analyzed values in a purposive manner as a gradient of an increasing dimension or of a position of at least one of the drive elements, but even to specify it for an anticipated stroke of the plunger.

The method can be further developed with the method features (which are optionally combinable) indicated below:

The press can advantageously be operated with a relation between the stroke of the plunger and the length of the connecting rod that is calculated according to a Fourier series.

The press is advantageously to be operated from the drive device to the plunger via at least two drive trains.

Each drive train is operated by its own motor or servo-motor.

Each drive train with a motor or servo-motor and tie rod is operated via the connective control and regulation device.

The die cushion apparatus is operated with a free space provided in the sub-structure. Such a free space can advantageously also be used and designed for the logistics of disposing of waste from processing the respective work piece.

At least one drive train can be operated mechanically or electrically or in a coupled or decoupled manner in the round trip of the respective stroke of the plunger by means of a detachable rotary or translational active connection between at least one of the drive elements of the drive train.

The mechanical coupling/decoupling occurs by positive fitting, force fitting or frictional engagement.

The operation of the press according to the calculation of a Fourier series can occur as an electric coupling/decoupling with the servo-motor, wherein the active connection comprises at least one of the following drive characteristics:

a) a torque or orientation regulation,
b) a control/regulation of the force and speed progression,
c) a force and torque-free operation,
d) an automatic operation of the press,
e) an external balance, or
f) an influence of gravity, and wherein the plunger can be moved in a torque-free operating mode of the servo-motor and this operating mode can be used for secure operational availability of the press.

Fulfilling the requirements of practical operation, at least one drive train is generally operated in a coupled manner during at least part of the downward stroke in order to achieve synchronization or compensation movements of the plunger. During at least part of the upward stroke, the drive train can be operated in a decoupled manner.

Depending on at least one of the values or gradients of the forming forces, speed or travel to be transmitted or one of the positions of the work step of forming, the drive elements or the position of the plunger, the active connection is closed or released or influenced depending on the force and orientation.

The method is furthermore to be completed by:

a) a speed of the plunger moving downward from or ahead or after a top dead center being slowed down just before the plunger connected to the upper tool part impacts on the bottom tool part, in order to reduce a percussion-type stress, and
b) after the impact of the upper tool part, the plunger being moved in a controlled or regulated manner downwards to the bottom dead center and then upwards.

In addition, the method can implement that:

a) ahead of or from its upper dead center until shortly before impacting on an element of the die cushion apparatus, the plunger is moved downward by means of its own gravity,
b) the plunger is thereby slowed down by means of a generator operation of the motor, in order to reduce the impact of the plunger on the element of the die cushion apparatus,
c) an element of the die cushion apparatus or the die cushion apparatus is moved downward with controlled speed and the work piece is formed, and
d) the plunger is then moved to the upper dead center or to the upper end position.

Moreover, according to the method:

a) the plunger is moved downward from its upper dead center in controlled drive,
b) wherein all the required values or gradients of a speed when impacting on an element of the die cushion apparatus and of a forming speed can be determined, and
c) the plunger is moved to the upper dead center or to the upper end position after forming the work piece.

After forming the work piece, the plunger can be moved to the upper dead center or the upper end position by application of a supporting force.

The method is particularly designed by the fact that in case of asymmetric forces occurring in the die cushion apparatus, the separately operated drive trains independently apply forces on the plunger, which provide a guidance causing the original movement of the plunger as well as a parallel movement of the upper tool part relative to the bottom tool part, said force applications preventing an inclination of the plunger as well as various impact blows of the plunger.

It has, however, been discovered that asymmetrically acting forces of the plunger can also be used advantageously and thus generated by the plunger impacting parallel onto the die cushion apparatus, for example, respectively in the absence of a die cushion apparatus by the plunger being moved parallel with the upper tool part so that it comes to bear on the bottom tool part. The two drive trains are thus moved a different distance in the direction of the bottom dead center, without, however, reaching it. A reversion (inversion of the rotational direction of the drive) and the upward movement of the plunger, subsequently occur.

A drive train can alternatively even travel through the bottom dead center and back to the upper dead center without reversion, whereas the other drive train is reversed and travels back to the upper dead center before reaching the bottom dead center. Taking into account the rigidity of the machine (Hooke's law), the respective position of the respective drive train or of an off-center element, for example, of the drive device is determining for generating the actually active force. Due to the unequal onward movement (rotation angle), a variably, i.e., asymmetrically acting press force, is generated via the spring rigidity of the machine.

For the operation of the press, the used control and regulation device allows collecting, analyzing, and inputting/adjusting of at least one of the values or parameters for at least one of the dimensions or gradients;

of forming forces, counterforces or a speed to be transmitted, or of one of the positions of the work steps of the forming process, the drive elements or the positions of the plunger.

The method for operating the press is completed by using a program with at least one of the following program functions:

a) Processing of the first to fifth data according to the function $$F(x) = \frac{L}{x} \cdot F_2$$

under the condition that $$L > x > \frac{L}{2}$$

so that the press can be permanently operated in a regulated and controlled manner according to a system of forces required for the work piece in accordance with the conditions of the work piece to be processed;

b) Processing of the first to fifth data according to a force and travel progression of the plunger according to the function $f(x)=a(0)/2+a(1)*\cos(1*x)+ \ldots +$ and under the conditions of the stroke (h) of the plunger (1.1) defined at the beginning according to the formula $a(0)/2+a(1)*\cos(1*x)+a(2)*\cos(2*x)+ \ldots +b(1)*\sin(1*x)+b(2)*\sin(2*x)+ \ldots$;

c) Processing the collected first to fourth and analyzed fifth data as controllable and adjustable target specifications for the drive device and the movement of the plunger, so that the forces to be transmitted by the upper tool part and the bottom tool part are locally differentiated but can act onto the work piece over a greater width;

d) Activation of commands for triggering actions:
   - for modifying values to be adjusted or put in for the operation of the press,
   - for overload protection, emergency operation or shutdown of the press, or
   - for the synchronous or asynchronous run of drive elements of the drive device, and
   - activation of commands for influencing reactions to the press force in the system of the press for shock absorption or in case of bending of the plunger for a modified force distribution:

e) Specification of an operation algorithm for press guidance according to the mandatorily required and optionally possible work processes of the press according to the features relevant to the present invention; and f) Visual presentation on a display of information relevant to the press from the operation algorithm, more specifically regarding operation sequences, operation situations and required interventions.

To this end, interfaces are provided for at least one of these program functions for respective integration into the programmed operation of a transfer press or press line as well as in their peripheral functions, for example, the programmed operation for the functions of a die cushion apparatus and/or a transfer device.

Compared to conventional implementations, the press with a bottom drive for implementing the method comprises:

at least one drive device disposed in a sub-structure, the drive elements of which form, together with at least one motor or servo-motor and at least one tie rod, a drive train for a plunger executing at least one stroke and accommodating a bottom tool part, at least one plunger executing a stroke and accommodating at least one upper tool part, several tie rods or connecting rods or tie rods and connecting rods acting on the plunger for transmitting the drive for the stroke of the plunger, and at least one lower tool part disposed in the sub-structure and associated with the plunger and the corresponding upper tool part as well as, the control and regulation device recording or adjusting data from conditions of the operational behavior of the press as well as controlling or adjusting or controlling and adjusting the drive device and the movement of the plunger.

This control and regulation device comprises at least:

a) a first means for collection of the first data of a travel progression as well as of a position from the stroke of the plunger, b) a second means for collection of the second data of a force in at least one tie rod or one connecting rod or one tie rod and one connecting rod, c) a third means for collection of the third data of values of a power consumption, a torque, an electrical current, a rotational speed or a rotational angle of at least one drive element (2.1), for example, of a motor, d) a fourth means for collection of the fourth data of at least one actual value of a power output or of an increase in power output in the system of the press or the combination of several of these means, and e) a fifth means for analysis of fifth data for triggering at least one of the actions:
   - for modifying values to be adjusted or put in for the operation of the press,
   - for overload protection, emergency operation or shutdown of the press, or
   - for the synchronous or asynchronous run of drive elements of the drive device.

By the combination of at least one of the first to fourth means for reception of at least one data (in the sense of a data file) of the first to fourth data with the fifth means for analysis of fifth data for influencing reactions to press forces in the system of the press for shock absorption or in case of bending of the plunger for a modified force distribution, the press is efficiently operable according to requirements corresponding largely to practice.

As a whole, the press is thus designed in such a manner that the plunger is loaded with forces acting in a differentiated manner by means of at least one acting tie rod or a connecting rod of a tie rod and a connecting rod as a consequence of the action of the fifth means of the control and regulation device.

The press can furthermore be designed with the following combinable features:

At least two drive trains are disposed between the drive device and the plunger.

Each drive train is connected to at least one distinct motor or servo-motor.

Each drive train with its motor or servo-motor and tie rod is connected to the control and regulation device.

A free space, which is usable as a scrap chute for a die cushion apparatus, is provided in the sub-structure.

At least one drive train has an electrically acting detachable rotational or translational active connection that is adapted to be coupled or decoupled in the round trip of the respective stroke of the plunger.

The mechanical active connection is a positive connection, force connection or frictional connection.

The electrical active connection comprises the servo-motor that can be operated according to a Fourier series as an electric coupling/decoupling, wherein this active connection comprises at least one of the following drive characteristics:

a) a torque or orientation regulation, b) a control/regulation of the force and speed progression, c) a force and torque-free operation, d) an automatic operation of the press, e) an external balance, or f) an influence of gravity.

As disclosed in the method, the plunger can be moved in a torque-free operation mode of the servo-motor and this operation mode can be used for secure operational availability of the press.

At least one drive train can be configured so that it is adapted to be coupled or decoupled during at least part of the downward stroke in order to achieve synchronization or compensation movements of the plunger.

An exemplary embodiment of the present invention will hereinafter be explained based on the drawings.

FIG. 1 shows an example of a press 1 with a drive device 2 disposed in a sub-structure 3 and connected to drive elements 2.1, 2.1.1, 2.1.2, 2.1.3. A plunger 1.1 executing a stroke h between a top dead center OT and a bottom dead center UT comprises an upper tool part 1.2. Two pairs of tie rods 2.1.2 and connecting rods 2.1.3 act in this example onto the plunger 1.1 for transmission of the drive for the stroke h of the plunger 1.1. The plunger 1.1 with the upper tool part 1.2 corresponds to a bottom tool part 3.2 disposed on the sub-structure 3, wherein the upper tool part 1.2 acts onto a work piece 5 lying on the bottom tool part 3.2 for forming. Said drive elements 2.1 comprise two motors 2.1.1 and the tie rods 2.1.2 with respectively one connecting rod 2.1.3, wherein each forms a drive train 2.1.4.

In this embodiment, the bottom tool part 3.2 is disposed on a table 3.1 belonging to the sub-structure 3.

A control and regulation device 4 in charge of operating the press 1 comprises 1. first means 4.1 for collection of first data 4.1.1 of a travel progression as well as of a position from the stroke h of the plunger 1.1,
2. second means 4.2 for collection of second data 4.2.1 of forces in the tie rods 2.1.2 or the connecting rods 2.1.3,
3. third means 4.3 for collection of third data 4.3.1 of values of a power consumption, a torque, an electrical current, a rotational speed or a rotational angle of at least one of the drive elements 2.1, in this case a motor current,
4. fourth means 4.4 for collection of fourth data 4.4.1 of an actual value of a power input or an increase in power input in the system of the press 1, and
5. a fifth means 4.5 for analysis of fifth data 4.5.1 for triggering actions:
   - for modifying values to be adjusted or put in for the operation of the press 1,
   - for overload protection, emergency operation or shutdown of the press 1, and
   - for the synchronous or asynchronous run of the drive elements 2.1, 2.1.1, 2.1.2, 2.1.3 of the drive device 2.

Figure 2:
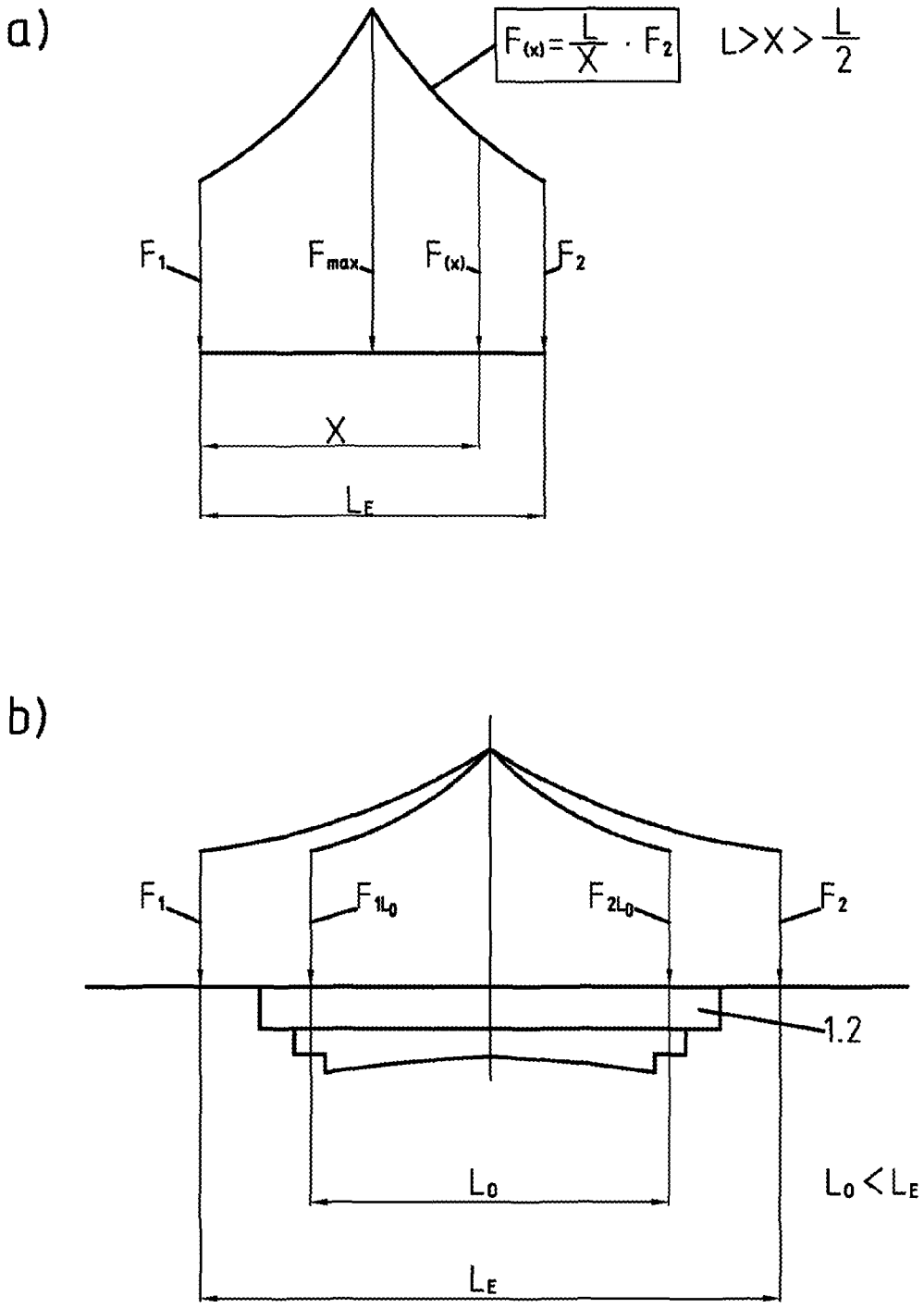
FIG. 2 shows a) a graphic representation of the functional principle according to the present invention, and b) a schematic diagram of the areas of acting forces according to the present invention as opposed to the prior art.

With the plunger 1.1, by way of the acting tie rods 2.1.2 and connecting rods 2.1.3, and as a consequence of the action of the fifth means 4.5 of the control and regulation device 4, the press applies forces acting in a differentiated manner onto the work piece 5 to be formed between the upper tool part 1.2 and the bottom tool part 3.2, as schematically shown in FIG. 2, image a) and image b).

To this end, values are collected from conditions in the system of the press 1 during processing of the work piece 5 and data processed according to FIG. 2*a*) in accordance with the function $$F(x) = \frac{L}{x} \cdot F_2$$

under the condition that $$L > x > \frac{L}{2}$$

is fed into the drive device 2 for the movement of the plunger, so that the press 1 is permanently operated according to a system of forces required for the work piece 5.

In the curve according to FIG. 2*a*), $F_1$ and $F_2$ represent as $$F(x) = \frac{L}{x} \cdot F_2$$

under the condition that $$L > x > \frac{L}{2}$$

the forces acting locally in a controlled manner over the area L, wherein $F_{max}$ refers to the maximally acting force and x to the area of a force acting in a differentiated or variable manner according to the present invention.

In FIG. 2*b*), the effect according to the present invention is schematically compared, based on forces $L_E$ acting in the extended area in the upper tool part 1.2, to an area $L_0$ covered to date, i.e., without the function according of the present invention, according to the prior art.

FIG. 2*b*) thus illustrates as a whole the inventive effect of the forces $F_1$ and $F_2$ in an area $L_E > L_0$ as opposed to the forces $L_{1Lo}$, and $F_{2Lo}$ acting to date.

The method makes it possible to record and process the values as data a) of a force and travel progression of the plunger 1.1 according to the function f(x)=a(0)/2+a(1)*cos(1*x)+ . . . +, and b) under the conditions of the stroke h of the plunger 1.1 according to the formula a(0)/2+a(1)*cos(1*x)+a(2)*cos(2*x)+ . . . +b(1)*sin (1*x)+b(2)*sin(2*x)+ . . . .

In FIG. 1, the method can be observed schematically or in terms of construction.

To begin with, first data 4.1.1 is collected by the first means 4.1 from values of the travel progression or a position from the stroke h of the plunger 1.1.

Second data 4.2.1 is then collected by the second means 4.2 from the collection of actual values of respectively one force or one force equivalent value in the drive elements 2.1, 2.1.1, 2.1.2, 2.1.3 of the drive device 2, wherein the second data 4.2.1 is advantageously gained from the collection of actual values of forces in the tie rods 2.1.2 and wherein conventional strain gauges or piezo elements can be disposed in the places of a force to be measured.

In the further course, third data 4.3.1 of actual values of the current of the motors or servo-motors 2.1.1 of the drive device 2 is collected by the third means 4.3.

Finally, fourth data is recorded by the fourth means 4.4 from the collection of actual values of an increase in power output in the system of the press 1.

This data is processed into fifth data 4.5.1 by the fifth means 4.5 and (adjusted to the values of data applying to the work piece 5) transmitted as virtual control signals via the drive device 2 and the plunger 1.1 onto the upper tool part 1.2 and the bottom tool part 3.2 for forming the work piece 5.

The forces then acting onto the upper tool part 1.2 and the bottom tool part 3.2 are applied onto the work piece to be processed, according to the conditions of the work piece 5, in a locally differentiated or variable manner and in an optimally extended area $L_E$ (as is shown in FIG. 2*b*).

As a whole, the processed fifth data 4.5.1 are analyzed in a target/actual comparison of the first to fourth collected data 4.1.1, 4.2.1, 4.3.1, 4.4.1 and fed or regulated and fed as target values by use of the fifth means (4.5) in order to trigger the following actions:

- modification of values to be adjusted for or fed into the operation of the press 1,
- overload protection, emergency operation or for shutdown of the press 1,
- synchronous or asynchronous run of drive elements 2.1, 2.1.1, 2.1.2, 2.1.3 of the drive device 2.

The analyzed fifth data is used to also influence reactions to press forces in the system of the press 1 for shock absorption or in case of bending of the plunger 1.1 for a modified force distribution.

The orientation, position and amount of the force can be actively modified depending, for example, on the "forming process", so that partial functions of a die cushion apparatus, not shown, can be assumed or actively supported as an effect merged with the main function.

The data for the overload protection, emergency operation or shutdown of the press 1 is triggered before reaching a set value of the first to fourth collected data 4.1.1, 4.2.1, 4.3.1, 4.4.1 and fifth analyzed data 4.5.1 of the required action or reaction force and measured, analyzed and, in case of a deviation from the target specification, specified as a gradient of an increasing force in one of the drive elements 2.1, 2.1.1, 2.1.2, 2.1.3, for modification of the distribution for an action or reaction force, more specifically for an anticipated learning stroke h of the plunger 1.1.

According to the method, the press 1 is operated in such a ratio of the stroke h of the plunger 1.1 to a length of the connecting rod 2.1.3 that corresponds to a calculation of the Fourier series.

In an embodiment of the present invention:

- the press 1 is operated from the drive device 2 to the plunger 1.1 via two drive trains 2.1.4,
- each drive train 2.1.4 is operated by its own motor or servo-motor 2.1,
- each drive train with its motor or servo-motor 1.1 and tie rods 2.1.2 is operated via the connecting control and regulation device 4,
- the die cushion apparatus (not shown) is operated with a free space 3.3 provided in the sub-structure 3,
- each drive train 2.1.4 is operated by means of a detachable rotational or translational active connection each between the drive train 2.1.4 that is adapted to be coupled or decoupled electrically or mechanically in the round trip of the respective stroke h of the plunger 1.1.

In an embodiment of the present invention, the drive train 2.1.4 can also be operated in an electrically or mechanically coupled or decoupled manner with the servo-motor 2.1.1, wherein the active connection 2.2 then comprises at least one of the drive characteristics:

d) a torque or orientation regulation,
e) a control/regulation of the force and speed progression,
f) a force and torque-free operation,
g) an automatic operation of the press,
h) an external balance, or
i) an influence of gravity.

In a torque-free operating mode of the servo-motor 2.1.1, the plunger 1.1 can be moved and this operating mode can be used for secure operational availability of the press 1.

Figure 4:
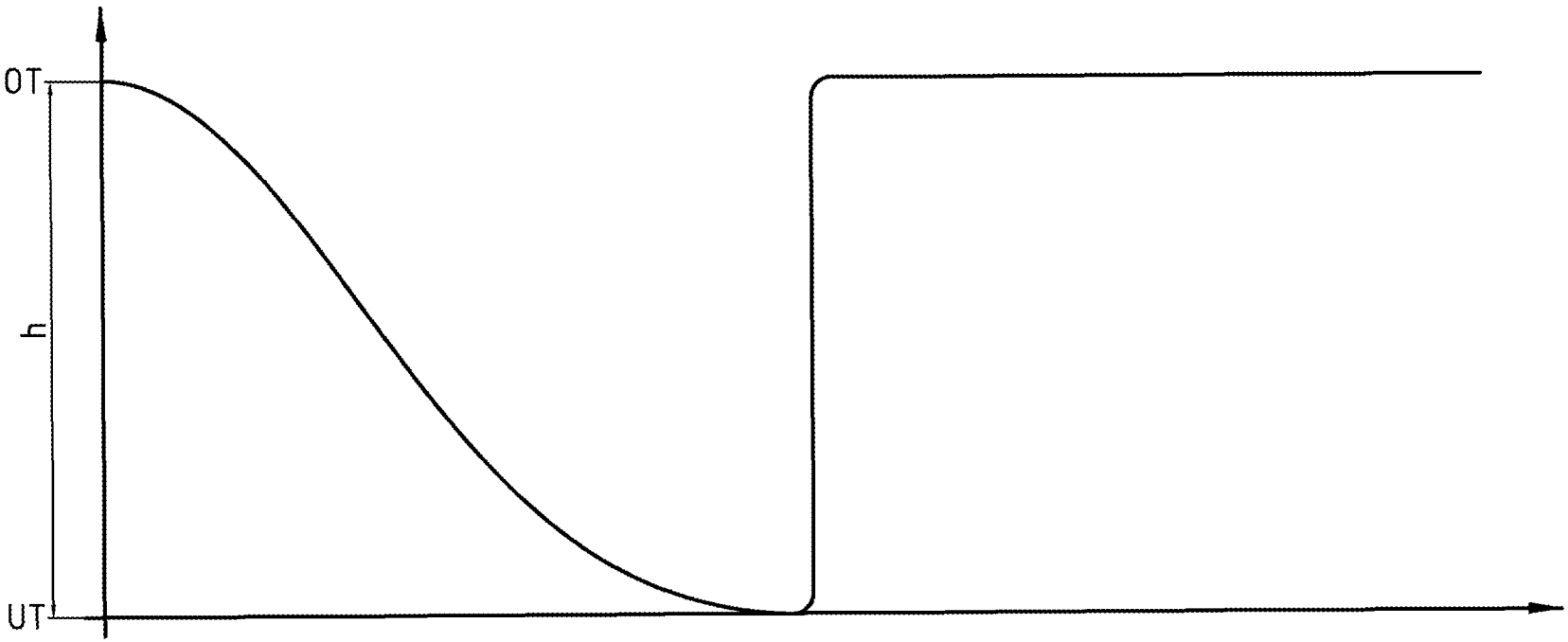
FIG. 4 shows a graphic representation of the curve of the plunger in the variant of its regulated movement after the top dead center, while using a die cushion apparatus (not shown).

This means that the drive trains 2.1.4 are intentionally driven by servo-motors 2.1.1 and operated in the operation modes torque or orientation regulation. The force and speed progression of the press 1 can thus be influenced, respectively controlled and regulated. As another (less common) mode, such a servo-drive, can also be operated free of force and torque. The press 1 is thus virtually "left alone". Depending on the use of complementary components, such as external balance or gravity influences, a plunger movement will still occur in the torque-free operating mode of the servo-motors, namely, as illustrated in FIGS. 2 and 4. As a whole, this operating mode is also advantageous in case of unexpected events, such as a power outage, since the drives can then be switched into the torque-free state as an emergency strategy, thus putting the press 1 into an operationally secure state.

In an embodiment of the present invention, the active connection 2.2 of the drive train 2.1.4 can be alternately closed and opened as a mechanical coupling in a positive-fitting, force fitting or frictional engagement.

In order to achieve synchronization or compensation movements of the plunger 1.1, the drive trains 2.1.4 are operated in a coupled manner during at least part of the downward stroke h and in a decoupled manner during at least part of the upward stroke h.

Depending on at least one of the values or gradients of the forming forces, speed or travel to be transmitted or one of the positions of the work step of forming, the drive elements 2.1 or the position of the plunger 1.1, the active connections 2.2 are closed or released or influenced depending on the force and orientation.

A speed of the plunger 1.1 moving downward from or ahead or after a top dead center OT is slowed down just before the plunger 1.1 connected to the upper tool part 1.2 impacts on the bottom tool part 3.2, in order to reduce a percussion-type stress, and after the impact of the upper tool part 1.2, the plunger 1.1 is moved in a controlled or regulated manner downwards to the bottom dead center UT and then upwards.

Figure 3:
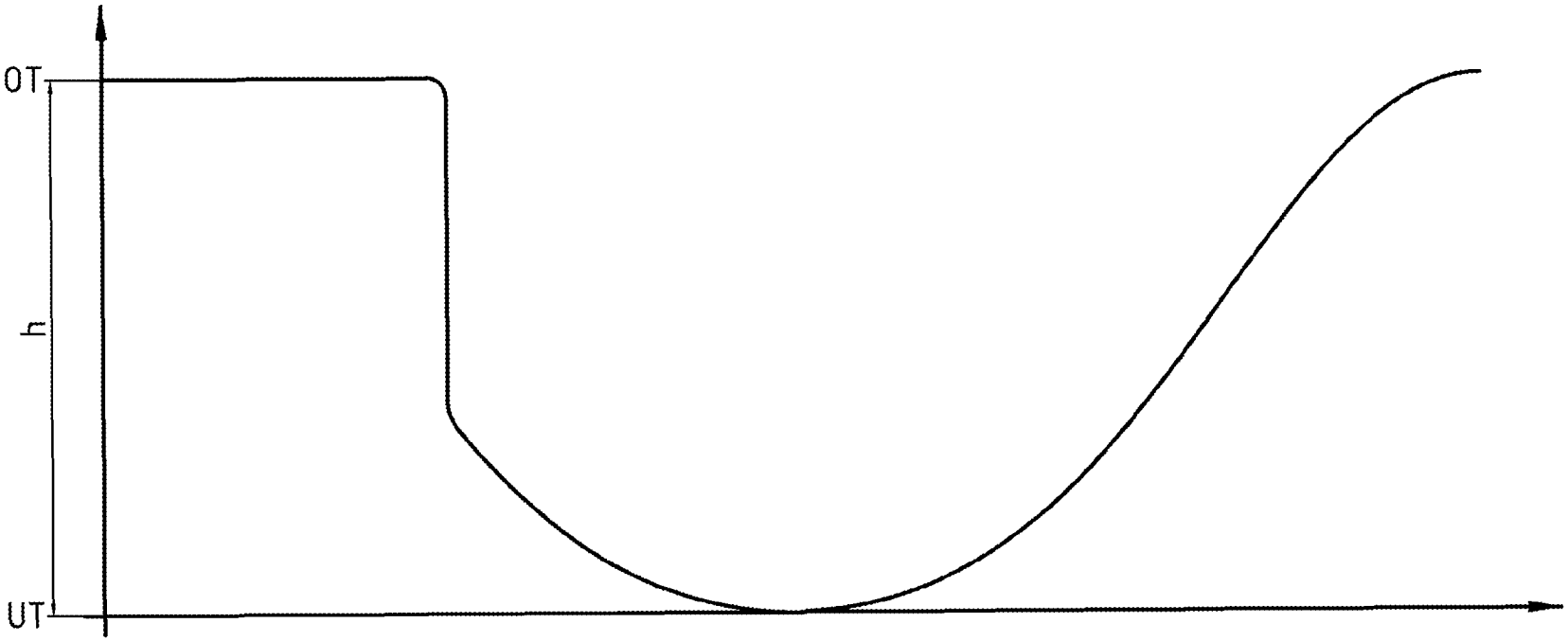
FIG. 3 shows a graphic representation of the curve of the plunger in the variant of its movement after the top dead center by means of its own gravity, while using a die cushion apparatus (not shown)

FIG. 3 graphically shows how, in an embodiment, the plunger 1.1 is moved downward ahead of or from its upper dead center by means of its own gravity until shortly before impacting on, for example, an element of the die cushion apparatus, wherein the plunger is thereby slowed down by means of a generator operation of the motor 2.1 (FIG. 1), in order to reduce the impact of the plunger 1.1 on the element of the die cushion apparatus (not shown), such as a conventional support or a conventional pressure cheek, and the element of the die cushion apparatus is subsequently moved downward at a controlled speed and the work piece 5 (FIG. 1) is formed and the plunger 1.1 is subsequently moved to the upper dead center or to the upper end position OT.

FIG. 4 graphically illustrates how the plunger 1.1 is moved downward from its upper dead center OT in a controlled drive, wherein all the required values or gradients of a speed can be determined at the impact on the element of the die cushion apparatus (as explained above) based on a forming speed, and how the plunger 1.1 is moved from the upper dead center or to the upper end position OT after forming the work piece 5.

After forming the work piece 5, the plunger 1.1 is driven to the upper dead center OT or the upper end position with the aid of force application.

In case of asymmetrically acting forces, such as in the die cushion apparatus, independent force applications onto the plunger 1.1 occur via the separately operated drive trains 2.1.4, which provide a guidance of the original, i.e., the intended movement of the plunger 1.1, as well as a parallel movement of the upper tool part 1.2 relative to the bottom tool part 3.2, said force applications preventing a skew of the plunger 1.1 as well as different impact blows of the plunger 1.1.

On the other hand, the exemplary embodiment also allows advantageously using asymmetrically acting forces of the plunger 1.1 and thus generating them by the plunger 1.1 impacting parallel onto the die cushion apparatus, for example, respectively, in the absence of a die cushion apparatus by the plunger being moved parallel with the upper tool part so that it comes to bear on the bottom tool part. To this end, the two drive trains 2.4 are moved a different distance in the direction of the bottom dead center UT, without however reaching it. A reversion (inversion of the rotational direction of the drive) and the upward movement of the plunger 1.1 subsequently occur.

A drive train 2.1.4 can alternatively even travel through the bottom dead center UT and back to the upper dead center without reversion, whereas the other drive train 2.1.4 is reversed and travels back to the upper dead center UT before reaching the bottom dead center UT.

The generation of the actually active force is derived from the respective position of the respective drive train 2.1.4 or, for example, of an off-center element of the drive device 2 by taking into account the rigidity of the machine (Hooke's law).

Based on this teaching, the press 1 is implementable in the following manner:

In principle, in case of asymmetrically acting forces, the plunger 1.1 is first movable in parallel from the upper dead center OT in the direction of the bottom dead center UT and a resulting unequal movement of the two drive trains 2.1.4 can now continue after the upper tool part 1.2 has impacted on the bottom tool part 3.2. The upper tool part 1.2 and the bottom tool part 3.2 are now closable in parallel. Due to the unequal continuing movement, asymmetrically and unequally acting forces become producible via the spring rigidity of the press 1.

In an embodiment of the present invention, the plunger 1.1 and the drive trains 2.1.4 are movable in the direction of the top dead center (OT) before reaching the bottom dead center UT and upon achieving the asymmetrically and unequally acting forces in the reversing operation (inversion of the rotational direction of the drive device), wherein the upper tool part 1.2 is movable away from the bottom tool part (3.2).

In an embodiment of the present invention, the press 1 can also be operated in such a manner that the greater force acting respectively in a drive train 2.1.4 is considered as a guiding value and said drive train 2.1.4 can be driven through the bottom dead center UT and then toward the top dead center OT without reversing operation. The other drive train 2.1.4 with the lesser acting force is configured so that it will stop before the bottom dead center UT and is reversible. Together with the first mentioned drive train 2.1.4, the plunger 1.1 will be drivable along with the upper tool part 1.2 in a parallel movement to the bottom tool part 3.2 back to the top dead center OT.

The method for operating the press described in the exemplary embodiment uses a program, which is adapted to be integrated into the control and regulation device 4, in which the following program functions are provided:

a) Processing the first to fifth data according to the function $$F(x) = \frac{L}{x} \cdot F_2$$

under the condition that $$L > x > \frac{L}{2}$$

so that the press (1) can be permanently operated in a regulated and controlled manner according to a system of forces required for the work piece 5 in accordance with the conditions of the work piece 5 to be processed;

b) Processing the first to fifth data according to a force and travel progression of the plunger (1.1) according to the function $f(x)=a(0)/2+a(1)*\cos(1*x)+ \ldots +$ and under the conditions of the stroke (h) of the plunger (1.1) according to the formula $a(0)/2+a(1)*\cos(1*x)+a(2)*\cos(2*x)+ \ldots +b(1)*\sin(1*x)+b(2)*\sin(2*x)+ \ldots$;

c) Processing the collected first to fourth and analyzed fifth data as controllable and adjustable target specifications for the drive device 2 and the movement of the plunger 1.1, so that the forces to be transmitted by the upper tool part 1.2 and the bottom tool part 3.2 can act on the work piece in a locally differentiated manner;

d) Activation of commands for triggering actions:
   - for modifying values to be adjusted or put in for the operation of the press 1,
   - for overload protection, emergency operation or shutdown of the press 1, or
   - for the synchronous or asynchronous run of drive elements 2.1, 2.1.1, 2.1.2, 2.1.3 of the drive device 2, and Activation of commands for influencing reactions to the press force in the system of the press 1 for shock absorption or in case of bending of the plunger 1.1 for a modified force distribution;

e) Specification of an operation algorithm for press guidance according to the required and possible work processes of the press 1; and f) Visual presentation on a display of information relevant to the press from the operation algorithm, more specifically regarding operation sequences, operation situations and required interventions with interfaces for said program functions for respective integration into the programmed operation of a transfer press or press line as well as in peripheral functions, such as the programmed operation of a die cushion and/or a transfer device.

The press with a bottom drive operated according to the method by means of a control and regulation device with an optimized force and travel progression of the plunger and its stroke provides an energy-saving operation to the user through forces that act and are used in a more efficient manner and simultaneously establishes the pre-condition required to be able to build the press with optimized performance data in a more compact way than with conventional presses with sub-structures.

The present invention is not limited to embodiments described herein; reference should be had to the appended claims.

LIST OF REFERENCE NUMBERS

1=press
1.1=plunger
1.2=upper tool part

2=drive device
2.1=drive element
2.1.1=motor or servo-motor
2.1.2=tie rod
2.1.3=connecting rod
2.1.4=drive train
2.2=translational or rotational active connection
3=sub-structure
3.1=table
3.2=bottom tool part
3.3=free space
4=control and regulation device
4.1=first means for collection of first data
4.1.1=first data of a travel progression and of a position from the stroke h of the plunger (1.1)
4.2=second means for collection of second data
4.2.1=second data of a force in at least one tie rod 2.1.2 or one connecting rod 2.1.3
4.3=third means for collection of third data
4.3.1=third data of values of a power consumption, a torque, a rotational speed, an electrical current, or a rotational angle of at least one drive element 2.1, such as a motor 2.1.1
4.4=fourth means for collection of fourth data
4.4.1=fourth data of at least one actual value of a power output or of an increase in power output in the system of the press 1
4.5=fifth means for processing, regulation and control of fifth dta
4.5.1=fifth data for triggering at least one of the actions and reactions
5=work piece
h=stroke, learning stroke
F(x)=force according to function controlled according to the present invention
$F_1$=locally acting force according to the present invention
$F_{1L0}$=force acting according to the prior art
$F_2$=locally acting force according to the present invention
$F_{2L0}$=force acting according to the prior art
$F_{max}$=maximum force according to the present invention
x=area of a variably acting force according to the present invention
$L_E$=variable area of acting forces according to the present invention ($L_E > L_0$)
$L_0$=fixed area of acting forces according to the present invention
OT=top dead center
UT=bottom dead center

What is claimed is:

1. A method for operating a press (1) with a bottom drive, the method comprising:

providing a press (1) comprising:

at least one plunger (1.1), the at least one plunger being configured to execute a stroke (h);

at least one upper tool part (1.2);

a sub-structure (3);

at least one drive device (2) disposed in the sub-structure (3), the at least one drive device (2) comprising drive elements (2.1), at least one motor or servo-motor (2.1.1) and at least one tie rod (2.1.2) which are arranged to form at least one drive train (2.1.4) for the at least one plunger (1.1) and to receive the at least one upper tool part (1.2);

at least one bottom tool part (3.2) disposed on the sub-structure (3);

a control and regulation device (4) configured to receive a value(s) on an operating condition from a system of the press (1);

wherein, the plunger (1.1) is configured to act with the at least one upper tool part (1.2) onto a work piece (5) to be processed lying on the at least one bottom tool part (3.2), wherein, the stroke (h) of the plunger (1.1) is operated via or ahead of a top dead center (OT) to or via a bottom dead center (UT); and providing the value(s) from the system of the press (1) to the control and regulation device (4) during a processing of the work piece (5);

processing the value(s) provided to the control and regulation device (4) according to a function:

$$F(x) = \frac{L}{x} \cdot F_2$$

under the condition that $$L > x > \frac{L}{2}$$

so as to permanently operate a movement of the plunger (1.1) via the at least one drive device (2) and the press (1) in a controlled manner or in a regulated manner according to a system of forces required for the work piece (5) with a respective force which is actively influenced or is actively modified in a position and a dimension/amount, wherein, F(x) represents a force controlled according to the function, $F_2$ represents a locally acting force, x represents an area of a variably acting force, and L represents a variable area of acting forces, and wherein the value(s) are collected and processed as data of at least, one force and travel progression, and one element of the at least one drive device (2), a change of the operating value in the system of the press (1) or a process of the work piece (5) to be processed, which influence the stroke (h) of the plunger (1.1).

2. The method as recited in claim 1, wherein the value(s) are collected and processed as data of a force and travel progression of the plunger (1.1) according to a function $f(x)=\alpha(0)/2+\alpha(1)*\cos(1*x)+\ldots+$, and based on conditions of the stroke (h) of the plunger (1.1) influenced by at least one element of the at least one drive device (2), a change of the value(s) in the system of the press (1) or of the work piece (5) to be processed, based on a formula $f(x)=\alpha(0)/2+60\ (1)*\cos(1*x)+60\ (2)*\cos(2*x)+\ldots+b(1)*\sin(1*x)+b(2)*\sin(2*x)+\ldots$.

3. The method as recited in claim 1, wherein the press (1) further comprises a first device (4.1), and wherein the method further comprises collecting first data (4.1.1) from a collection of values of a travel progression or a position from the stroke (h) of the plunger (1.1) via the first device (4.1).

4. The method according to one of the claim 3, wherein the press (1) further comprises a second device (4.2), and wherein the method further comprises collecting second data (4.2.1) from a collection of at least one actual value of a force or of a force-equivalent value in the drive elements (2.1, 2.1.1, 2.1.2, 2.1.3) of the at least one drive device (2) via the at least one second device (4.2).

5. The method as recited in claim 4, wherein the press (1) further comprises at least one connecting rod (2.1.3), and wherein the method further comprises collecting the second data (4.2.1) from the collection of at least one actual value of a force in at least one of the at least one tie rod (2.1.2) and in the one of the at least one connecting rod (2.1.3) via the at least one second device (4.2).

6. The method as recited in claim 5, wherein the second data (4.2.1) is collected by a strain gauge or a piezo element attached to the at least one tie rod (2.1.2) or to the at least one connecting rod (2.1.3).

7. The method as recited in claim 6, wherein the press (1) further comprises a third device (4.3), and wherein the method further comprises collecting third data (4.3.1) of at least one actual value of the at least one motor or servo-motor (2.1.1) via the third device (4.3).

8. The method as recited in claim 7, wherein the third data (4.3.1) is collected from values of a power consumption, a torque, a motor current, a rotational speed or a rotational angle of the drive elements (2.1, 2.1.1, 2.1.2, 2.1.3) via the third device (4.3).

9. The method as recited in claim 8, wherein the press (1) further comprises a fourth device (4.4), and wherein the method further comprises collecting and recording fourth data (4.4.1) from at least one change of an actual value or a change of the operating value in the system of the press (1) via the fourth device (4.4).

10. The method as recited in claim 9, wherein the press (1) further comprises a fifth device (4.5), and wherein the method further comprises analyzing or regulating at least one of the first data (4.1.1), the second data (4.2.1), the third data (4.3.1) and the fourth data (4.4.1) so as to provide fifth data (4.5.1) via the fifth device (4.5).

11. The method as recited in claim 9, wherein the press (1) further comprises a fifth device (4.5), and wherein the method further comprises:

at least one of recording, analyzing, processing or regulating at least one data/a data file of the first data, the second data, the third data and the fourth data (4.1.1, 4.2.1, 4.3.1, 4.4.1) into fifth data (4.5.1);

comparing or regulating the fifth data recorded by the fifth device into values of data;

applying the values of data to the work piece (5) by the fifth device (4.5); and transmitting the values of data as virtual control signals via the at least one drive device (2) and the plunger (1.1) to the at least one upper tool part (1.2) and the at least one bottom tool part (3.2), wherein, forces acting onto the at least one upper tool part (1.2) and the at least one bottom tool part (3.2) are at least one of applied and regulated onto the work piece (5) in a locally differentiated manner or in a dimensionally varied manner according to conditions of the work piece (5) to be processed.

12. The method as recited in claim 11, further comprising:

analyzing the fifth data (4.5.1) into at least one target/actual comparison of at least one of the first data, the second data, the third data and the fourth data (4.1.1, 4.2.1, 4.3.1, 4.4.1) so as to obtain analyzed fifth data; and feeding the at least one target/actual comparison via the fifth device (4.5) so as to trigger at least one of the following actions:

a modification of values to be adjusted for or fed into for an operation of the press (1), an overload protection, an emergency operation or a shutdown of the press (1), and a synchronous run or an asynchronous run of the drive elements (2.1, 2.1.1, 2.1.2, 2.1.3).

13. The method as recited in claim 12, further comprising:

using at least one of the first data, the second data, the third data, the fourth data (4.1.1, 4.2.1, 4.3.1, 4.4.1) and the analyzed fifth data (4.5.1) to influence reactions to a press force in the system of the press (1) for a shock absorption or, in a case of a bending of the plunger (1.1), for a modified force distribution.

14. The method as recited in claim 13, wherein the press (1) further comprises a die cushion apparatus, and wherein the method further comprises:

actively assuming at least a partial function of the die cushion apparatus via a triggering of actions or of the reactions.

15. The method as recited in claim 14, further comprising a set value of an action or reaction force of at least one of the first data, the second data, the third data, the fourth data, and the analyzed fifth data, and wherein the method further comprises:

triggering data for the overload protection, the emergency operation or the shutdown of the press (1) before reaching the set value of the action or reaction force.

16. The method as recited in claim 15, further comprising:

measuring and analyzing data of at least one of the first data, the second data, the third data, the fourth data, and the analyzed fifth data as a gradient of a dimension or a position of the drive elements (2.1, 2.1.1, 2.1.2, 2.1.3) and, if a deviation from a target specification, exists, implementing a newly specified reaction force for a modification of a distribution.

17. The method as recited in claim 16, further comprising:

measuring, analyzing and specifying the first data, the second data, the third data, the fourth data, and the analyzed fifth data for an anticipated learning stroke (h) of the plunger (1.1) as a gradient of a dimension or a position of the drive elements (2.1, 2.1.1, 2.1.2, 2.1.3).

18. The method as recited in claim 17, further comprising:

operating the press (1) with a relation between the stroke (h) of the plunger (1.1) and a length of the connecting rod (2.1.3) which is calculated according to a Fourier series.

19. The method as recited in claim 18, wherein the at least one drive train (2.1.4) comprises at least two drive trains, and the method further comprises:

operating the press (1) from the at least one drive device (2) to the plunger (1.1) via the at least two drive trains (2.1.4).

20. The method as recited in claim 19, wherein each drive train (2.1.4) comprises and is configured to be operated by a respective at least one motor or a servo-motor (2.1.1).

21. The method as recited in claim 20, wherein each drive train (2.1.4) and each at least one tie rod (2.1.2) is connected to and is operated via the connecting control and regulation device (4).

22. The method as recited in claim 21, wherein the die cushion apparatus is operated with a free space (3.3) arranged within the sub-structure (3).

23. The method as recited in claim 22, wherein the press (1) further comprises a detachable rotational or translational active connection (2.2) arranged between at least one of the drive elements (2.1) of the at least one drive train (2.1.4), and wherein the at least one drive train (2.1.4) is configured to be operated electrically or mechanically in a coupled manner or in a decoupled manner during a round trip of a respective stroke (h) of the plunger (1.1) via the detachable rotational or translational active connection (2.2).

24. The method as recited in claim 23, wherein the at least one drive train (2.1.4) comprising the motor or servo-motor (2.1.1) is configured to be operated electrically in a coupled manner or in a decoupled manner, and wherein the detachable rotational or translational active connection (2.2) comprises at least one of the following drive characteristics:

a torque regulation or an orientation regulation,
a control/regulation of a force and speed progression,
a force-free operation and a torque-free operation,
an automatic operation of the press (1),
an external balance, and
an influence of gravity,
wherein the plunger (1.1) is configured to be moved in a torque-free operating mode of the motor or servo-motor (2.1.1).

25. The method as recited in claim 24, wherein the detachable rotational or translational active connection (2.2) of the at least one drive train (2.1.4) is configured to be alternately closed and opened as a mechanical coupling in at least one of a positive-fitting, a force fitting and a frictional engagement.

26. The method as recited in claim 25, further comprising:

operating the at least one drive train (2.1.4) in a coupled manner during at least a part of a downward stroke (h); and
operating the at least one drive train (2.1.4) in a decoupled manner during at least a part of an upward stroke (h),
so as to achieve a synchronization movement or a compensation movement of the plunger (1.1).

27. The method as recited in claim 26, wherein, when an asymmetrically force acts on the plunger (1.1), the method further comprises:

moving the plunger (1.1) in parallel from the top dead center (OT) in a direction of the bottom dead center (UT); and
continuing a resulting unequal movement of the at least two drive trains (2.1.4) after the at least one upper tool part (1.2) has impacted on the at least one bottom tool part (3.2) so that the at least one upper tool part (1.2) and the at least one bottom tool part (3.2) are closed in parallel and, due to the unequal continuing movement, asymmetrically and unequally acting forces are specifically produced via a spring rigidity of the press (1).

28. The method as recited in claim 27, wherein the method further comprises:

moving the plunger (1.1) and the at least one drive train (2.1.4) in a direction of the top dead center (OT) before reaching the bottom dead center (UT); and
moving the at least one upper tool part (1.2) away from the at least one bottom tool part (3.2) upon achieving asymmetrically and unequally acting forces in a reversing operation.

29. The method as recited in claim 28, wherein the press (1) further comprises a first drive train and a second drive train (2.1.4), and wherein the method further comprises:

using a greater force acting on the first drive train (2.1.4) as a guiding value to operate the press (1);
driving the first drive train (2.1.4) through the bottom dead center (UT) and then to the top dead center (OT) without reversing an operation;
stopping and reversing the second drive train (2.1.4) with a lesser force before the bottom dead center (UT); and
driving the plunger (1.1) together with the first drive train (2.1.4) and the at least one upper tool part (1.2) in a parallel movement to the bottom tool part (3.2) back to the top dead center (OT).

30. The method as recited in claim 29, wherein, depending on at least one of values or gradients of the forming forces, speed or travel to be transmitted, a position of work steps of forming, the drive elements (2.1), or a position of the plunger (1.1), the method further comprising closing, releasing or influencing the detachable rotational or translational active connection (2.2) depending on a force and an orientation.

31. The method as recited in claim 30, wherein the method further comprises:

reducing a speed of the plunger (1.1) moving downward from, ahead of, or after the top dead center (OT) directly before the plunger (1.1) connected to the at least one upper tool part (1.2) impacts on the at least one bottom tool part (3.2) so as to reduce a percussion-type stress; and
after the impact of the at least one upper tool part (1.2), moving the plunger (1.1) in a controlled manner or in a regulated manner downwards to the bottom dead center (UT) and then upwards.

32. The method as recited in claim 31, wherein the method further comprises:

moving the plunger (1.1) downward via its own gravity ahead of or from its top dead center (OT) until shortly before impacting on an element of the die cushion apparatus;
slowing the plunger (1.1) down via a generator operation of the motor or servo-motor (2.1.1) so as to reduce an impact of the plunger (1.1) on the element of the die cushion apparatus;
moving the element of the die cushion apparatus downward with a controlled speed so as to form the work piece (5); and
moving the plunger (1.1) to the top dead center or to the upper end position (OT).

33. The method as recited in claim 32, wherein the method further comprises:

moving the plunger (1.1) downward from its upper dead center (OT) in a controlled drive so that all required values or gradients of a speed upon impacting on the element of the die cushion apparatus and of a forming speed can be determined; and
moving the plunger (1.1) to the top dead center or to the upper end position (OT) after forming the work piece (5).

34. The method as recited in claim 33, wherein, after forming the work piece (5), the method further comprises:

driving the plunger (1.1) to the top dead center (OT) or to the upper end position by application of a supporting force.

35. The method as recited in claim 34, wherein, when an asymmetrical force acts in the die cushion apparatus, the method further comprises:

applying an independent force onto the plunger (1.1) via the at least one drive train (2.1.4) which is separately operated so as to provide a guidance of an original movement of the plunger (1.1) as well as a parallel movement of the at least one upper tool part (1.2) relative to the at least one bottom tool part (3.2), the application of the independent force preventing a skew of the plunger (1.1) and a different impact blow of the plunger (1.1).

36. The method as recited in claim 35, wherein the control and regulation device (4) is used for collecting, analyzing, and inputting/adjusting of at least one of the values or parameters for at least one of the dimensions or gradients of:

a forming force, a counterforce or a speed to be transmitted, or a position of a work step of a forming process, the drive elements (2.1) or a position of the plunger (1.1), for an operation of the press (1).

37. The method as recited in claim 36, wherein the method further comprises using a program with at one of the following program functions:

processing the first data, the second data, the third data, the fourth data and the fifth data according to a function $$F(x) = \frac{L}{x} \cdot F_2$$

under the condition that $$L > x > \frac{L}{2}$$

so that the press (1) is permanently operateable in a regulated manner and in a controlled manner according to a system of forces required for the work piece (5) in accordance with conditions of the work piece to be processed;

processing the first data, the second data, the third data, the fourth data and the fifth data according to a force and travel progression of the plunger (1.1) according to a function $f(x)=\alpha(0)/2+\alpha(1)*\cos(1*x)+ \ldots +$ and under conditions of the stroke (h) of the plunger (1.1) defined at a beginning according to a formula $\alpha(0)/2+\alpha(1)*\cos(1*x)+\alpha(2)*\cos(2*x) + \ldots +b(1)*\sin(1*x)+b(2)*\sin(2*x)+ \ldots$;

processing the first data, second data, third data, fourth data and the analyzed fifth data collected as controllable and adjustable target specifications for the at least one drive device (2) and a movement of the plunger (1.1), so that forces to be transmitted by the at least one upper tool part (1.2) and the at least one bottom tool part (3.2) can act in a locally differentiated manner onto the work piece (5);

activating of commands for triggering actions:

for modifying values to be adjusted or fed into for an operation of the press (1), for the overload protection, the emergency operation or the shutdown of the press (1), or for the synchronous run or the asynchronous run of the drive elements (2.1, 2.1.1, 2.1.2, 2.1.3) of the drive device (2), and activating commands for influencing reactions to the press force in the system of the press (1) for the shock absorption or, in case of the bending of the plunger (1.1), for the modified force distribution;

specifying an operation algorithm for a press guidance according to a mandatorily required and possible work processes of the press (1); and visually presenting on a display information relevant to the press (1) from the operation algorithm such as operation sequences, operation situations and required interventions, wherein, interfaces are provided for at least one of the program functions for respective integration into a programmed operation of a transfer press or a press line as well as in their peripheral functions.

38. A press (1) with a bottom drive the press (1) comprising:

at least one plunger (1.1), the at least one plunger being configured to execute a stroke (h);

at least one upper tool part (1.2);

a sub-structure (3);

at least one drive device (2) disposed in the sub-structure (3), the at least one drive device (2) comprising drive elements (2.1), at least one motor or servo-motor (2.1.1) and at least one tie rod (2.1.2) which are arranged to form at least one drive train (2.1.4) for the at least one plunger (1.1) and to receive the at least one upper tool part (1.2);

at least one bottom tool part (3.2) disposed on the sub-structure (3), wherein the plunger (1.1) is configured to act with the at least one upper tool part (1.2) onto a work piece (5) to be processed lying on the at least one bottom tool part (3.2);

a control and regulation device (4) configured to receive a value(s) on an operating condition from a system of the press (1), the control and regulation device (4) comprising at least one of:

a first device (4.1) configured to collect first data (4.1.1) of a travel progression as well as of a position of the stroke (h) of the plunger (1.1), a second device (4.2) configured to collect second data (4.2.1) of a force in at least one of the at least one tie rod (2.1.2) and a connecting rod (2.1.3), a third device (4.3) configured to collect third data (4.3.1) of values of a power consumption, a torque, a motor current, a rotational speed or a rotational angle of the at least one drive element (2.1), a fourth device (4.4) configured to collect fourth data (4.4.1) of at least one actual value of a power output or of an increase in power output in a system of the press (1), and a fifth device (4.5) configured to analyze fifth data (4.5.1) for triggering at least one of the actions selected from:

modifying values to be adjusted or to be fed into for an operation of the press (1), for an overload protection, an emergency operation or a shutdown of the press (1), and for a synchronous run or an asynchronous run of the drive elements (2.1) of the drive device (2), wherein the system of the press (1) provides the value(s) to the control and regulation device (4) during a processing of the work piece (5);

the control and regulation device (4) processing the value(s) provided to the control and regulation device(4) according to the function:

$F(x)=L/x\cdot F_2$ under the condition that $L>x>L/2$ so as to permanently operate a movement of the plunger (1.1) via the at least one drive device (2) and the press (1) in a controlled manner or in a regulated manner according to a system of forces required for the work piece (5) with a respective force which is actively influenced or is actively modified in a position and a dimension/amount, wherein, F(x) represents a force controlled according to the function, F2 represents a locally acting force, x represents an area of a variably acting force, and L represents a variable area of acting forces, and wherein the value(s) are collected and processed as data of at least, one force and travel progression, and one element of the at least one drive device (2), a change of the operating value in the system of the press (1) or a process of the work piece (5) to be processed, which influence the stroke (h) of he plunger (1.1).

39. The press (1) as recited in claim 38, wherein at least one of the first device, the second device, the third device and the fourth device (4.1, 4.2, 4.3, 4.4) are combined to record at least one data of the first data, the second data, the third data, and the fourth data (4.1.1, 4.2.1, 4.3.1, 4.4.1) with the fifth device (4.5) for analysis of fifth data (4.5.1) to influence reactions to press forces in the system of the press (1) for a shock absorption or, in case of a bending of the plunger (1.1) for, a modified force distribution.

40. The press (1) as recited in claim 39, wherein the plunger (1.1) is subjectable to differentially acting forces via at least one of the at least one tie rod (2.1.2) and the one connecting rod (2.1.3) as a consequence of an effect of the fifth device (4.5).

41. The press (1) as recited in claim 40, wherein at least two drive trains (2.1.4) are disposed between the drive device (2) and the plunger (1.1).

42. The press (1) as recited in claim 41, wherein each of the at least two drive trains (2.1.4) comprises at least one motor or servo-motor (2.1.1).

43. The press (1) as recited in claim 42, wherein the at least one tie rod (2.1.2) is connected with the control and regulation device (4).

44. The press (1) as recited in claim 43, wherein a free space (3.3) is arranged in the sub-structure, the free space (3.3) being configured to be usable as a scrap chute or for a die cushion apparatus (3).

45. The press (1) as recited in claim 44, wherein the at least one drive train (2.1.4) comprises an electrically or a mechanically-acting detachable rotational or translational active connection (2.2) that is configured to be coupled or decoupled in a round trip of the respective stroke (h) of the plunger (1.1).

46. The press (1) as recited in claim 45, wherein the electrically or mechanically-acting detachable rotational or translational active connection (2.2) comprises the at least one motor or servo-motor (2.1.1).

47. The press (1) as recited in claim 46, wherein the electrically or mechanically-acting detachable rotational or translational active connection (2.2) is a positive connection, a force connection or a frictional connection.

48. The press (1) as recited in claim 47, wherein the at least one drive train (2.1.4) is configured to be coupled or decoupled during at least part of the stroke (h) so as to achieve a synchronization movement or a compensation movement of the plunger (1.1).

49. The press (1) as recited in claim 48, wherein, when an asymmetrical force acts on the plunger (1.1), the plunger (1.1) is configured to be movable in parallel from a top dead center (OT) in a direction of a bottom dead center (UT) and to continue a resulting unequal movement of the at least two drive trains (2.1.4) after the at least one upper tool part (1.2) has impacted on the at least one bottom tool part (3.2), wherein, the at least one upper tool part (1.2) and the at least one bottom tool part (3.2) are now parallel and asymmetrically and unequally acting forces are thereby specifically produced.

50. The press (1) as recited in claim 49, wherein the plunger (1.1) and the at least one drive train (2.1.4) are configured to be movable in a direction of the top dead center (OT) before reaching the bottom dead center (UT) and upon achieving an asymmetrically and unequally acting force in a reversing operation/inversion of a rotational direction of the drive device, wherein, the at least one upper tool part (1.2) is configured to be movable away from the at least one bottom tool part (3.2).

51. The press (1) as recited in claim 50, wherein the press (1) further comprises a first drive train and a second drive train (2.1.4), and wherein:

a greater force acting on the first drive train (2.1.4) acts as a guiding value to operate the press (1);

the first drive train (2.1.4) is drivable through the bottom dead center (UT) and then to the top dead center (OT) without reversing an operation/inversion of the rotational direction of the drive device;

the second drive train (2.1.4) with a lesser force is configured to be stoppable and reversible before the bottom dead center (UT); and the plunger (1.1) together with the first drive train (2.1.4) and the at least one upper tool part (1.2) is configured to be drivable in a parallel movement to the bottom tool part (3.2) back to the top dead center (OT).

* * * * *

UNITED STATES PATENT AND TRADEMARK OFFICE

CERTIFICATE OF CORRECTION

PATENT NO. : 9,302,441 B2
APPLICATION NO. : 13/818368
DATED : April 5, 2016
INVENTOR(S) : Spiesshofer et al.

It is certified that error appears in the above-identified patent and that said Letters Patent is hereby corrected as shown below:

In the claims,

Col. 18, claim 2, line 4, change "f(x) = α(0)/2 + α(1) *" to -- f(x) = a(0)/2 + a(1) * --.

Col. 18, claim 2, line 10, change "f(x) = α(0)/2 + 60(1) * cos (1 * x) + 60" to -- f(x) = a(0)/2 + a(1) * cos (1 * x) + a --.

Col. 18, claim 4, line 1, delete "one of the".

Col. 23, claim 37, line 25, change "f(x) = α(0)/2 + α(1) * cos (1 * x) +...+" to -- f(x) = a(0)/2 + a(1) * cos (1 * x) +...+ --.

Col. 23, claim 37, line 27, change "α(0)/2 + α(1) * cos" to -- a(0)/2 + a(1) * cos --.

Col. 23, claim 37, line 28, change "(1 * x) + α(2) * cos (2 * x)" to -- (1 * x) + a(2) * cos (2 * x) --.

Signed and Sealed this
Twelfth Day of July, 2016

Michelle K. Lee

Michelle K. Lee
*Director of the United States Patent and Trademark Office*